US012378876B2

(12) United States Patent
Su et al.

(10) Patent No.: US 12,378,876 B2
(45) **Date of Patent: *Aug. 5, 2025**

(54) DOWNHOLE TO SURFACE COMMUNICATIONS PLATFORM FOR DRILLING APPLICATIONS

(71) Applicant: National Technology & Engineering Solutions of Sandia, LLC, Albuquerque, NM (US)

(72) Inventors: Jiann-Cherng Su, Albuquerque, NM (US); Jason P. Krein, Albuquerque, NM (US); John Joseph Borchardt, Albuquerque, NM (US); Richard Ellis Robey, Sandia Park, NM (US); Andrew Alexander Wright, Albuquerque, NM (US); Joseph Samuel Pope, Rio Rancho, NM (US); Taylor Anthony Myers, Albuquerque, NM (US); Mark C. Grubelich, Albuquerque, NM (US); Douglas A. Blankenship, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/387,160

(22) Filed: Nov. 6, 2023

(65) Prior Publication Data

US 2024/0068363 A1 Feb. 29, 2024

Related U.S. Application Data

(63) Continuation of application No. 17/087,987, filed on Nov. 3, 2020, now Pat. No. 11,808,144.

(51) Int. Cl.
*E21B 47/13* (2012.01)
*E21B 17/02* (2006.01)

(52) U.S. Cl.
CPC ..... *E21B 47/13* (2020.05); *E21B 17/0285* (2020.05)

(58) Field of Classification Search
CPC ..... E21B 47/13; E21B 17/0285; E21B 17/028
See application file for complete search history.

(56) References Cited

U.S. PATENT DOCUMENTS 5,276,415 A * 1/1994 Lewandowski ..... H01R 29/00 333/260
5,677,631 A * 10/1997 Reittinger ..... E21B 47/113 324/324

(Continued)

*Primary Examiner* — Amine Benlagsir
(74) *Attorney, Agent, or Firm* — Daniel J. Jenkins

(57) ABSTRACT

A drilling assembly for downhole to surface communications is provided. The drilling assembly includes a series of pipe segments coupled in fluid communication between a slip ring assembly and an end pipe portion. The slip ring assembly is coupled in data and fluid communication with the pipe segments. A surface communications link is in data communication with the drilling assembly via the slip ring assembly. An end pipe portion is coupled with the drilling assembly that includes an electronics assembly with electronic components for transferring data to the slip ring assembly via the drilling assembly. A drill bit is operably coupled with the end pipe portion for drilling a borehole. Each pipe segment includes an outer conductor portion, a hollow inner conductor portion, and a dielectric portion for electrical isolation between the outer conductor portion and the inner conductor portion.

19 Claims, 4 Drawing Sheets

(56) References Cited

U.S. PATENT DOCUMENTS

| | | | | |
|---|---|---|---|---|
| 6,392,317 | B1 * | 5/2002 | Hall | E21B 17/028 340/854.3 |
| 6,717,501 | B2 * | 4/2004 | Hall | E21B 47/13 336/15 |
| 2007/0023185 | A1 * | 2/2007 | Hall | E21B 17/028 166/65.1 |
| 2011/0133740 | A1 * | 6/2011 | Seydoux | G01V 3/28 324/338 |
| 2011/0266472 | A1 * | 11/2011 | Russell | E21B 21/106 251/28 |
| 2013/0186669 | A1 | 7/2013 | Chabas et al. | |
| 2020/0067247 | A1 * | 2/2020 | He | E21B 47/00 |
| 2021/0005352 | A1 | 1/2021 | Okoniewski et al. | |

* cited by examiner

DOWNHOLE TO SURFACE COMMUNICATIONS PLATFORM FOR DRILLING APPLICATIONS

RELATED APPLICATIONS

This application is a Continuation of U.S. patent application Ser. No. 17/087,987, filed on Nov. 3, 2020, entitled "DOWNHOLE TO SURFACE COMMUNICATIONS PLATFORM FOR DRILLING APPLICATIONS," the entirety of which is incorporated herein by reference.

STATEMENT REGARDING FEDERALLY SPONSORED RESEARCH OR DEVELOPMENT

This invention was developed under Contract No. DE-NA0003525 awarded by the United States Department of Energy/National Nuclear Security Administration. The Government has certain rights in this invention.

BACKGROUND OF THE INVENTION

The application generally relates to communications platforms and systems. The application relates more specifically to communications platforms and systems to provide a data link between downhole sensors and surface equipment in drilling installations.

Drilling technology has advanced recently to allow boreholes extending over great distances. Operators require accurate data on environmental operating parameters in deep boreholes. Communication systems with sensitive electronic sensors and circuitry are difficult to install and maintain in such harsh environments. Fluid conduits carry cooling fluid to the drill head through drill segments, are subject to leakage and may be corrosive to sensitive electronics equipment. Providing a continuous sealed conduit for fluid while transmitting data to the surface presents a significant challenge.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

One embodiment relates to a drilling assembly for downhole to surface communications. The drilling assembly includes a series of pipe segments coupled in fluid communication between a slip ring assembly and an end pipe portion. The slip ring assembly is coupled in data communication and in fluid communication with the pipe segments. A communications link is located at the surface of the drill hole, in data communication with the drilling assembly via the slip ring assembly. An end pipe portion is coupled with the last pipe segment of the drilling assembly at the bottom of the drill hole. The end pipe portion includes an electronics assembly having electronic components for transferring data to the slip ring assembly via the drilling assembly. A drill bit is operably coupled with the end pipe portion for drilling a borehole. Each pipe segment includes an outer conductor portion, a hollow inner conductor portion, and a dielectric portion for electrical isolation between the outer conductor portion and the inner conductor portion.

Another embodiment relates to a pipe segment for a drilling assembly. The pipe segment includes an outer conductor portion, a hollow inner conductor portion, and a dielectric portion for electrical isolation between the outer conductor portion and the inner conductor portion. The inner conductor portion defines a sealed fluid passage through the drilling assembly.

Another embodiment relates to an electronics assembly for a downhole to surface communications system for a drilling assembly. The electronics assembly includes a first end connection to a pipe segment of the drilling assembly. A second end is connected to a drill bit. A data link is included for communicating data between the electronics assembly and a surface communications link. The electronics assembly also has a radio frequency transceiver, a specialty drill pipe, and a radio frequency receiving means for extracting a data signal.

An advantage is the present system is a design and assembly of a drill pipe that conducts radio frequency (RF) signals.

Another advantage is a drill pipe for transmitting alternating current (AC) and direct current (DC) signals from a downhole location to surface communications equipment.

Still another advantage is means of providing electrical power to the downhole sensors as well as signal transmission. Transmission frequencies can range from kilohertz (kHz) to megahertz (MHz) to enable data transfer rates that exceed existing technology employed in the downhole communications.

A slip-ring joint may be employed for electrical continuity between an inner conductor and the surface receiver in which the signal is extracted from the drill pipe through the slip ring assembly.

Alternative exemplary embodiments relate to other features and combinations of features as may be generally recited in the claims.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
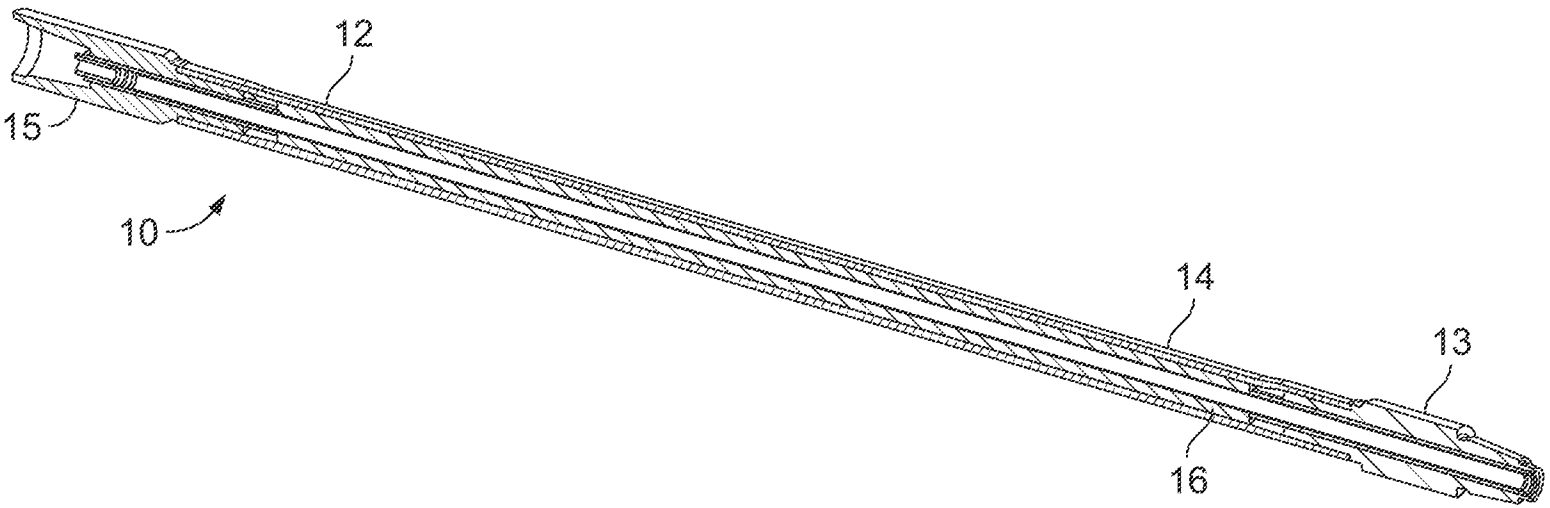
FIG. 1 shows an exemplary drill pipe segment of the present invention.

Referring to FIG. 1, a drill pipe segment 10 has an outer conductor portion 12. Outer conductor portion 12 is made of conductive material, e.g., steel or a similarly conductive metal, a dielectric portion 14 disposed between an inner conductor portion 16 and outer conductor portion 12. Dielectric portion 14 insulates inner conductor portion 16 from outer conductor portion 12. Inner conductor 16 is a hollow cylindrical pipe which serves as an electrical conductor as well as a conduit for a controlled fluid path. A male coupler portion 13 is attached to each drill pipe segment 10 at one end, and a female coupler portion 15 is connected at an opposite end of drill pipe segment 10, to allow a continuous string of drill pipe segments to be interconnected in electrical, data and fluid communication.

Figure 2:
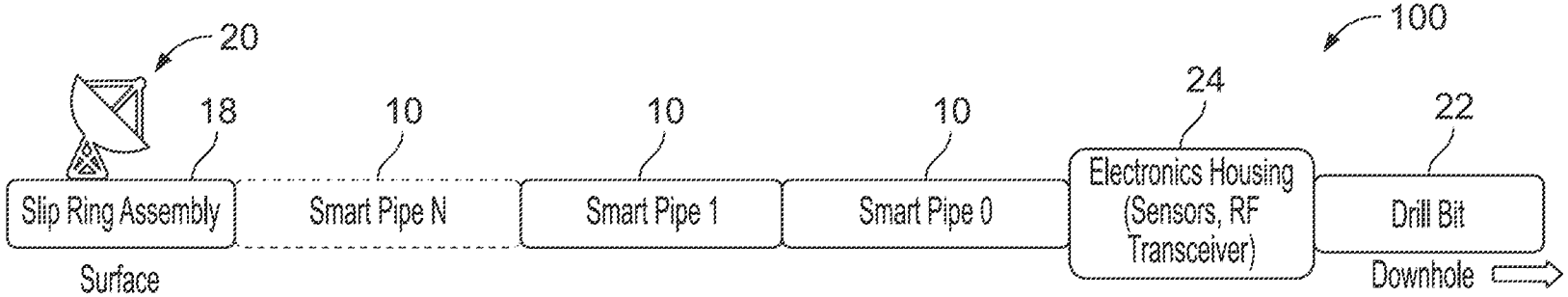
FIG. 2 shows a block diagram of a drill pipe assembly with electronics.

Referring next to FIG. 2, multiple pipe segments 10 may be coupled in serial fluid communication to form a drilling assembly 100 that extends to desired drilling depths. A slip ring assembly 18 (FIG. 6) connects the drill pipe segments 10 that are mechanically coupled, e.g., via tapered threads as described in greater detail below, or by other suitable connection means. A communications link 20 is located at the surface and is in data communication with drill pipe assembly 100 through slip ring assembly 18. At the end of drill pipe assembly 100 in the downhole location opposite the surface, a drill bit 22 is coupled with an end pipe portion 24. End pipe portion 24 is coupled with drill pipe assembly 100 and transfers torque to drill bit 22 to bore the drill hole. End pipe portion 24 houses electronics with downhole sensors for collecting data and transmitting data communications to communications link 20 via drill pipe assembly 100.

Figure 3:
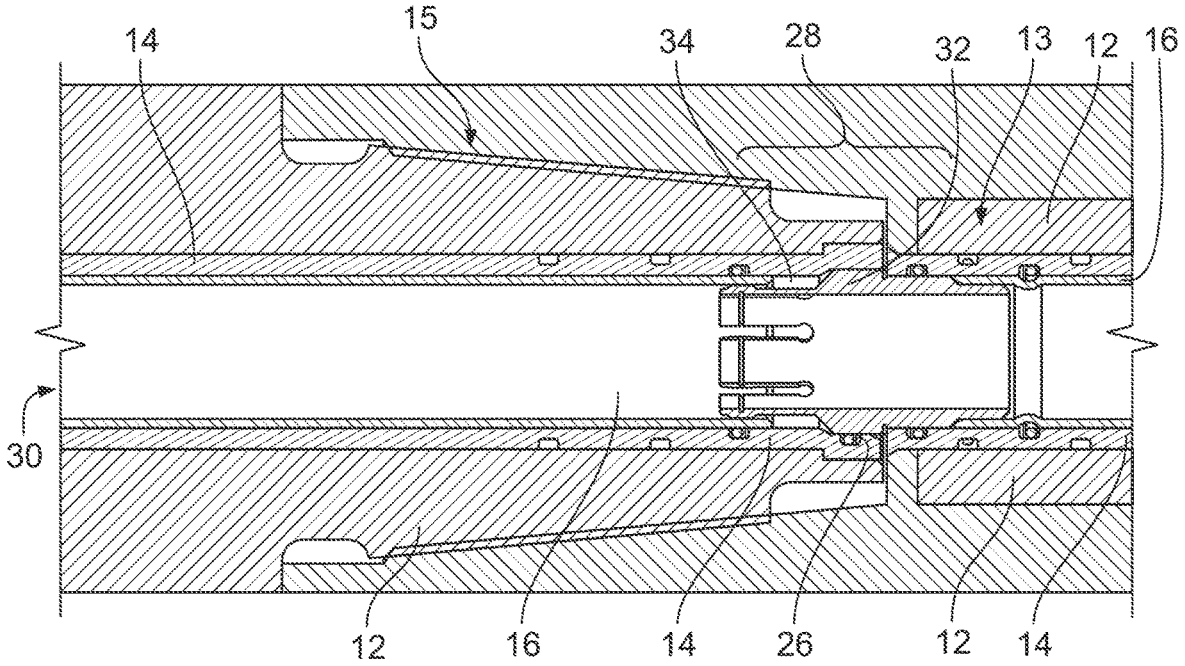
FIG. 3 shows a detailed cross-sectional view of a drill pipe segment coupling.

Referring next to FIG. 3, drill pipe assembly 100 maintains continuity through drill pipe segments 10 via inner conductor 16. A compliant contact arrangement 32 is made of a conductive material that bridges a gap 28 between adjacent pipe joints 13, 15 to provide a sealed fluid path or conduit 30, and electrical conductivity between pipe segments 10. Contact arrangement 32 mates with an adjoining inner conductor portion 16 via contact arrangement 32. An O-ring 26 seals fluid around the contact arrangement. Contact arrangement 32 includes a center contact and insulator 14. A centralizing alignment ramp 34 is provided to ensure alignment and proper engagement between pipe segments 10 when coupled. This provides a more robust interface between the box-side center contact 32 and the conductor 16 in female coupler portion 15. In an alternate embodiment, a spherical interface may be configured in a conventional ball and socket arrangement between adjoining pipe segments 10, with a spring between contact arrangement 32 and inner conductor portion 16 to provide positive engagement force with the adjoining inner conductor 16.

Figure 4:
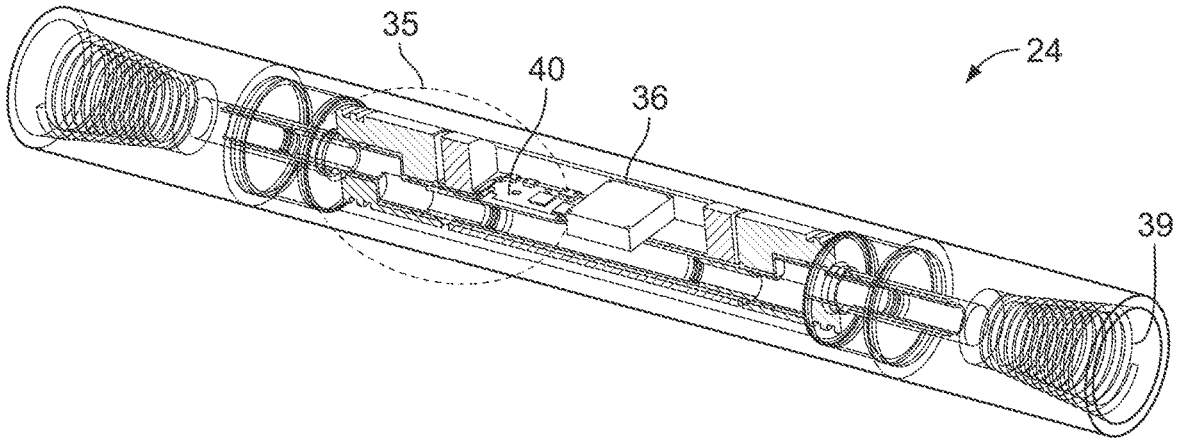
FIG. 4 shows a transparent perspective view of an end pipe portion.

Referring next to FIG. 4, a transparent perspective view of end pipe portion 24 is shown. End pipe portion 24 includes a sub-surface electronics assembly 36. Sub-surface electronics assembly 36 is a communication platform used to provide a data link between downhole electronics including by way of example and not limitation, navigation sensors, force and torque sensors, accelerometers, and surface equipment used to process data. Sub-surface electronics assembly 36 comprises a downhole radio frequency (RF) transceiver, a specialty drill pipe, and a surface radio frequency (RF) receiver that provides a means of extracting the signal. In an embodiment, communications from about a few MHz/MBit to about 500 m have a range of attenuation between 10 dB to 20 dB. In an exemplary embodiment, communications out to 5 kilometers (km) are available at reduced data rates from 100-500 kHz/kBit. Attenuation for a coaxial drill pipe assembly configured as shown in FIGS. 1 and 2 indicate acceptable levels for a length of 500 m and signal frequency of 5 MHz, for copper inner conductor portion 16, a steel outer conductor portion, and a polyvinyl chloride (PVC) dielectric portion 14. Attenuation at 500 m and 5 MHz is about 13 dB and 32 dB for PVC tan(d) 0.025 and 0.07, respectively.

Sub-surface electronics assembly 36 further includes an inertial measurement unit (IMU), hydrostatic pressure sensor and batteries. Additional electronics components may be provided as needed. Various combinations of electronics components described herein may be selected as appropriate for existing downhole environments. Further, a sealed atmospheric chamber 35 is integrated within sub-surface electronics assembly 36 to isolate electronic components 40 from fluid in flow path 30. Internal threads 39 provide connection means with external pipe segments 10 and drill bit 22.

Figure 5:
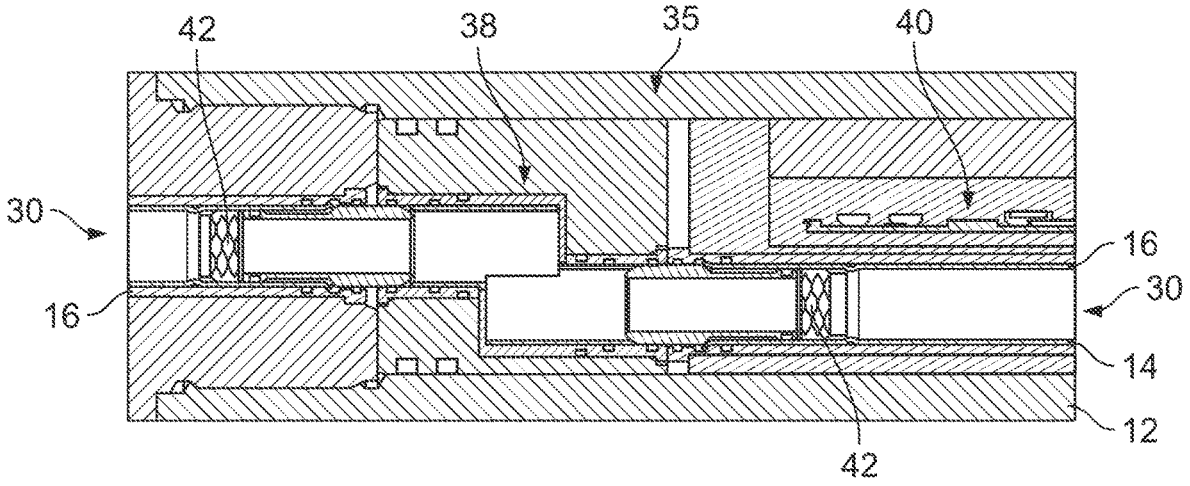
FIG. 5 shows an enlarged detail of sealed atmospheric chamber 35 in sub-surface electronics assembly.

FIG. 5 shows an enlarged detail of sealed atmospheric chamber 35 in sub-surface electronics assembly 36. Electronics components 40 are maintained in the sealed atmospheric chamber 35. An exemplary bulkhead assembly 38 couples flow path 30 at an offset connection, wherein flow path 30 is axially displaced between adjacent inner conductor portions 16. Springs 42 ensure positive engagement between inner conductor portions 16.

Figure 6:
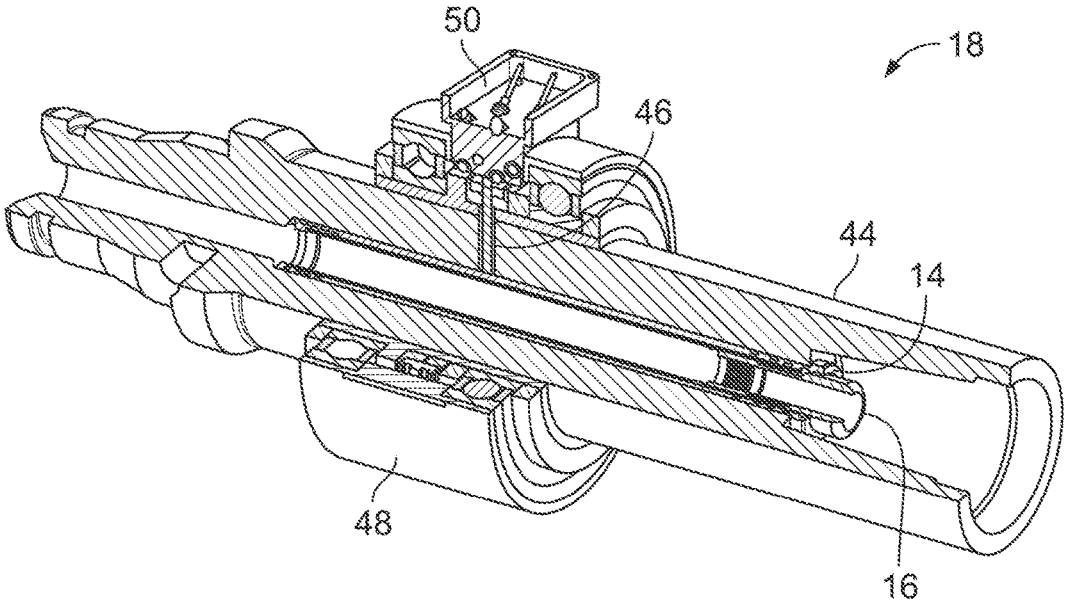
FIG. 6 shows a detail of an exemplary slip-ring assembly of the drill pipe assembly of FIG. 2.

Referring now to FIG. 6, a slip-ring assembly 18 is shown. As discussed above with respect to FIG. 2, slip-ring assembly 18 provides the communication interface with communications link 20 at the surface of the borehole. An internal mandrel 44 rotates with pipe segment 10 and dielectric portion 14, and waveguide 46. A stationary sleeve portion 48 supports the rotary pipe segment 10. Slip-ring assembly 18 conveys signals from rotating waveguide to a stationary data port 50. Data port 50 provides the conductors to transmit and receive electronic communication signals between communications link 20 and downhole electronics module 24.

Figure 7:
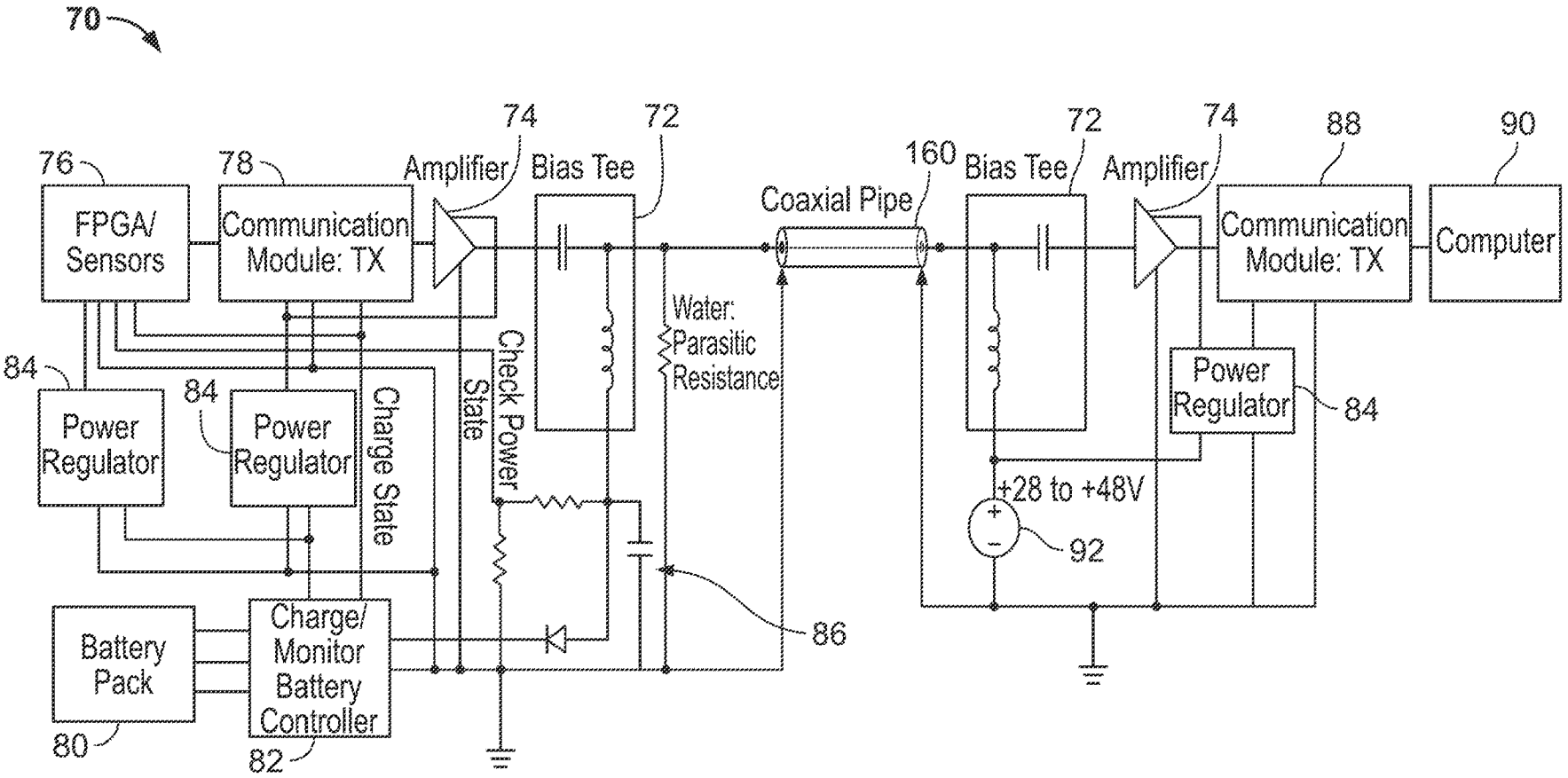
FIG. 7 shows a schematic diagram of the system electronics for transmitting data and power signals.

Referring next to FIG. 7, a system schematic diagram 70 is shown. Drill pipe assembly 100 is represented schematically as a coaxial line. Bias tee circuits 72 are connected at opposite ends of drill pipe assembly to transfer electrical power while sustaining RF signals. Variable gain amplifiers (not shown) may be required to accommodate for signal attenuation based on the length of drill pipe assembly 100. In an embodiment, a low noise amplifier may be provided for up-hole communications and a power amplifier for down-hole communications. Power amplifiers with two-way communication measure feedback to tune the gain of the variable gain amplifier. At bias tees 72, amplifiers 74 amplify input and output signals, respectively.

At an input terminal, or downhole location, an IMU 76 may include, e.g., a field programmable gate array (FPGA) and sensors. IMU 76 generates a signal to communications transmitter module 78 connected in series with IMU 76. A battery pack 80, e.g., 7.4 volt lithium battery, or super capacitor may be connected to a battery charger/monitor 82, provides regulated DC power to IMU 76 and communications transmitter module 78, and to input amplifier 74 and bias tee 72. A voltage divider R-C circuit 86 is connected to IMU 76, transmitter module 78, battery charger 82 and power regulators to provide charge power state feedback input. At the output terminal or upper surface location, coaxial drill pipe assembly 100 is connected to another bias tee circuit 72. The output signal of circuit 72 is amplified by amplifier 74, and inserted to a receiver communications module 88, in data communication with a computer 90. Bias tee 72 and power regulator 84 receive input power from a DC voltage source 92, e.g., 28 to 48 volts DC. Regulator 84 provides a regulated DC voltage from source 92 to receiver communications module 88 and amplifier 72. Battery pack 80 stores energy and is used when power is disconnected up-hole to allow the system to collect data without interruption, if required. When in use, the system may be configured with sleep mode to conserve energy until power is restored from the surface power source. In an exemplary embodiment, transmitter module 78 and receiver module 88 may be, e.g., an integrated transceiver, Model MAX 9947 manufactured by Maxim Integrated of San Jose, California, or other suitable RF communication board having wideband, e.g., kHz to MHz, operating frequency. In an exemplary embodiment, transceivers 78, 88 may be configured at 2.176 MHz operating frequency, with On-off keying, output power ranging from +7 to +12 dBm, and receiver power ranging from −15 to +5 dBm at 50 ohms (Ω). Supply voltage may be from 3 to 5.5 VDC with a 16-pin TQFN package. Data rates for transceivers 78, 88 may be available up to 115.2 kbps and transmitter power consumption of 160 mW.

While the exemplary embodiments illustrated in the figures and described herein are presently preferred, it should be understood that these embodiments are offered by way of example only. Accordingly, the present application is not limited to a particular embodiment but extends to various modifications that nevertheless fall within the scope of the appended claims. The order or sequence of any processes or method steps may be varied or re-sequenced according to alternative embodiments.

The present application contemplates methods, systems and program products on any machine-readable media for accomplishing its operations. The embodiments of the present application may be implemented using an existing computer processors, or by a special purpose computer processor for an appropriate system, incorporated for this or another purpose or by a hardwired system.

It is important to note that the construction and arrangement of the downhole to surface communications platform for drilling, as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A drilling assembly for downhole to surface communications, comprising:

a plurality of pipe segments coupled in serial fluid communication, a slip ring assembly, and an end pipe portion;

the slip ring assembly coupled in data communication and in the serial fluid communication with the plurality of pipe segments;

a communications link disposed at a surface adjoining above ground in the data communication with the drilling assembly through the slip ring assembly;

the end pipe portion coupled to a final pipe segment of the drilling assembly, the end pipe portion comprising an electronics assembly, the electronics assembly comprising at least one electronic component for transferring data to the slip ring assembly via the drilling assembly; and a drill bit operably coupled with the end pipe portion for drilling a borehole;

each pipe segment of the plurality of pipe segments comprising an outer conductor portion, a hollow inner conductor portion, and a dielectric portion disposed between said outer conductor portion and said hollow inner conductor portion; the dielectric portion insulating the hollow inner conductor portion from electrical contact with the outer conductor portion;

wherein the hollow inner conductor portion forming a tube that defines a fluid communication pathway through the drilling assembly; and wherein the outer conductor portion and the hollow inner conductor portion are not in the electrical contact.

2. The drilling assembly of claim 1, wherein the slip ring assembly comprises:

a stationary sleeve portion supporting a rotatable internal mandrel;

the internal mandrel connected to said each pipe segment of the plurality of pipe segments;

a first dielectric portion and a waveguide;

the waveguide in the data communication with a data port disposed on the sleeve portion; the data port comprising one or more conductors to transmit and receive electronic communication signals between the communications link and the electronics assembly; and the internal mandrel coupled to the drilling assembly with drill segments to generate torque to the drill bit.

3. The drilling assembly of claim 1, wherein the outer conductor portion comprises a conductive material.

4. The drilling assembly of claim 1, wherein the electronics assembly comprises a data link between the electronics assembly, the electronics assembly further comprising a radio frequency transceiver, a specialty drill pipe, and a radio frequency receiving means for extracting a data signal.

5. The drilling assembly of claim 4, wherein the electronics assembly further comprises a plurality of electronic components for generating the data to the communications link; the plurality of electronic components selected from a navigation sensor, a force sensor, a torque sensor, accelerometers, and surface equipment used to process the data.

6. The drilling assembly of claim 5, wherein radio frequency communications are configured up to 500 meters (m) with a range of attenuation between 10 dB to 20 dB.

7. The drilling assembly of claim 6, wherein the plurality of pipe segments extend up to 5 kilometers, and transmit frequencies in the range of 100 KHz/kBit to 500 KHz/kBit with attenuation between 13 dB to 32 dB.

8. The drilling assembly of claim 1, wherein said each pipe segment comprises a first end having a male coupler portion, and a second end opposite the first end, the second end comprising a female coupler portion, wherein adjacent pipe segments of the plurality of pipe segments being connected continuously in the drilling assembly for the serial fluid communication and the data communication.

9. The drilling assembly of claim 8, wherein a female interface portion is configured at the first end and a male interface portion is configured at the second end; the female interface portion having a first tapered end co-operable with a second tapered end of the male interface portion to align the hollow inner conductor portion of said each pipe segment or respective connected drill segments.

10. The drilling assembly of claim 1, further comprising a compliant contact arrangement disposed between adjacent pipe segments of the plurality of pipe segments of the drilling assembly, the compliant contact arrangement configured to seal a fluid path and conduct electrical signals between the adjacent pipe segments; wherein a first contact portion mateable with an adjoining second contact portion; the first contact portion comprising a first center contact and a first insulator connected with a second center contact and a second insulator of an adjacent contact portion when coupled.

11. The drilling assembly of claim 10, further comprising a spherical interface having a ball and a first spring at a first end and a socket and a second spring at a second end, wherein the ball and the socket are positively engaged between respective adjoining inner conductor portions.

12. A pipe segment for a drilling assembly comprising:

an outer conductor portion, a hollow inner conductor portion, and a dielectric portion disposed between said outer conductor portion and said hollow inner conductor portion; the dielectric portion insulating said hollow inner conductor portion from electrical contact with the outer conductor portion; the hollow inner conductor portion forming a tube that defines a sealed fluid passage through the drilling assembly therethrough when a plurality of pipe segments are continuously fluidly connected;

wherein the outer conductor portion and the hollow inner conductor portion are not in the electrical contact; and wherein the pipe segment further comprising:

a first end having a male coupler portion, and a second end opposite the first end;

the second end comprising a female coupler portion co-operable with an adjacent pipe segment for connecting continuously in the drilling assembly with the sealed fluid passage and data communication.

13. The pipe segment of claim 12, further comprising:

a female interface portion disposed at the first end and a male interface portion disposed at the second end;

the female interface portion having a first tapered end co-operable with a second tapered end of the male interface portion to align the hollow inner conductor portion to connect the pipe segment in the sealed fluid passage and the data communication with the adjacent pipe segment.

14. The pipe segment of claim 12, further comprising:

a compliant contact arrangement;

the compliant contact arrangement configured to seal a fluid path and conduct electrical signals between adjacent pipe segments;

wherein a contact portion of the compliant contact arrangement being mateable with an adjoining contact portion;

the contact portion comprising a first center contact and a first insulator cooperative with a second center contact and a second insulator of the adjoining contact portion when coupled.

15. The pipe segment of claim 14, further comprising:

a spherical interface having a ball and a first spring at the first end and a socket and a second spring at the second end, wherein the ball and the socket are positively engaged by the first and second springs disposed between adjoining inner conductor portions.

16. An electronics assembly for a downhole to surface communications system for a drilling assembly, the electronics assembly comprising:

a first end configured for connection to a pipe segment of the drilling assembly, and a second end configured for connection to a drill bit, the pipe segment having a hollow inner conductor portion and an outer conductor portion, the first end configured to electrically connect to the hollow inner conductor portion to provide a data signal to the hollow inner conductor portion and being electrically isolated from the outer conductor portion;

wherein the hollow inner conductor portion forming a tube that defines a sealed fluid passage therethrough when a plurality of pipe segments are continuously fluidly connected;

wherein the pipe segment further comprising:

the first end having a male coupler portion, and the second end opposite the first end;

the second end comprising a female coupler portion co-operable with an adjacent pipe segment for a continuous connecting of the drilling assembly with the sealed fluid passage and data communication; and a data link between the electronics assembly and a surface communications link, a radio frequency transceiver, a specialty drill pipe, and a radio frequency receiving means for extracting the data signal.

17. The electronics assembly of claim 16, further comprising a plurality of electronic components for generating data to the surface communications link; the plurality of electronic components selected from a navigation sensor, a force sensor, a torque sensor, accelerometers, and surface equipment used to process the data.

18. The electronics assembly of claim 17, wherein radio frequency communications parameters are configured up to 500 meters (m) with a range of attenuation between 10 dB to 20 dB.

19. The electronics assembly of claim 16, wherein the drilling assembly comprises a series of interconnected pipe segments of the plurality of pipe segments to extend up to 5 kilometers, and transmit frequencies in a range of 100 KHz/kBit to 500 KHz/kBit with attenuation between 13 dB to 32 dB.

* * * * *